US009399906B2

(12) United States Patent
Parsche

(10) Patent No.: US 9,399,906 B2
(45) Date of Patent: Jul. 26, 2016

(54) HYDROCARBON RESOURCE HEATING SYSTEM INCLUDING BALUN HAVING A FERRITE BODY AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 511 days.

(21) Appl. No.: 13/959,059

(22) Filed: Aug. 5, 2013

(65) Prior Publication Data

US 2015/0034304 A1 Feb. 5, 2015

(51) Int. Cl.

| | |
|---|---|
| ***E21B 43/24*** | (2006.01) |
| ***E21B 36/00*** | (2006.01) |
| ***E21B 36/04*** | (2006.01) |

(52) U.S. Cl.

CPC ..... *E21B 43/2401* (2013.01); *E21B 36/04* (2013.01); *H05B 2214/03* (2013.01)

(58) Field of Classification Search

CPC ... E21B 43/2401; E21B 36/04; E21B 47/122; E21B 43/2408; E21B 17/028; H05B 2214/03; H05B 6/62

USPC ..... 166/302, 248, 60; 219/415, 417, 418, 219/419

See application file for complete search history.

(56) References Cited

U.S. PATENT DOCUMENTS

| | | | | |
|---|---|---|---|---|
| 4,620,593 | A | 11/1986 | Haagensen | |
| 7,441,597 | B2 | 10/2008 | Kasevich | |
| 7,889,026 | B2 | 2/2011 | Parsche et al. | |
| 2010/0065265 | A1 | 3/2010 | Kasevich | |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2012/0061380 | A1 | 3/2012 | Parsche | |
| 2012/0318498 | A1 | 12/2012 | Parsche | |
| 2014/0110395 | A1 | 4/2014 | Parsche | |
| 2014/0224472 | A1* | 8/2014 | Parsche | H01Q 9/16 166/60 |
| 2014/0231416 | A1* | 8/2014 | Wright | E21B 43/2401 219/679 |
| 2014/0262224 | A1* | 9/2014 | Ayers | E21B 43/2401 166/248 |
| 2015/0007974 | A1* | 1/2015 | Parsche | E21B 43/2401 166/57 |
| 2015/0013985 | A1* | 1/2015 | Parsche | E21B 17/18 166/302 |
| 2015/0034303 | A1 | 2/2015 | Parsche | |

* cited by examiner

*Primary Examiner* — Michael Wills, III

(74) *Attorney, Agent, or Firm* — Allen, Dyer, Doppelt, Milbrath & Gilchrist, P.A. Attorneys at Law

(57) ABSTRACT

A system for heating hydrocarbon resources in a subterranean formation having a wellbore therein includes a coaxial transmission line, a balun, and a radio frequency (RF) antenna coupled together in series and configured to be positioned in the wellbore so that the RF antenna heats the hydrocarbon resources in the subterranean formation. The coaxial transmission line includes an inner conductor and an outer conductor surrounding the inner conductor. The balun includes an outer conductive sleeve having a proximal end coupled to the outer conductor of the coaxial transmission line and a medial portion coupled to the inner conductor of the coaxial transmission line. An inner tubular conductor extends longitudinally within the outer conductive sleeve between the outer conductor of the coaxial transmission line and the RF antenna. The balun also includes a ferrite body surrounding the inner tubular conductor at the proximal end.

20 Claims, 7 Drawing Sheets

HYDROCARBON RESOURCE HEATING SYSTEM INCLUDING BALUN HAVING A FERRITE BODY AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RF source, transmission line, and/or antenna. These mismatches become particularly acute with increased heating of the subterranean formation. Such system may also suffer from inefficiencies as a result of non-uniform RF energy heating patterns such that RF energy is directed into areas of the subterranean formation with reduced hydrocarbon resources.

SUMMARY OF THE INVENTION

In view of the foregoing background, it is therefore an object of the present invention to provide a hydrocarbon resource heating system that provides more efficient hydrocarbon resource heating.

This and other objects, features, and advantages in accordance with the present invention are provided by a system for heating hydrocarbon resources in a subterranean formation having a wellbore therein. The system includes a coaxial transmission line, a balun, and a radio frequency (RF) antenna coupled together in series and configured to be positioned in the wellbore so that the RF antenna heats the hydrocarbon resources in the subterranean formation. The coaxial transmission line includes an inner conductor and an outer conductor surrounding the inner conductor. The balun includes an outer conductive sleeve having a proximal end coupled to the outer conductor of the coaxial transmission line and a medial portion coupled to the inner conductor of the coaxial transmission line. An inner tubular conductor extends longitudinally within the outer conductive sleeve between the outer conductor of the coaxial transmission line and the RF antenna. The balun also includes a ferrite body surrounding the inner tubular conductor at the proximal end. Accordingly, the hydrocarbon resource heating system provides more efficient heating by increasing tuning accuracy while reducing the number of components within a relatively small form factor.

A method aspect is directed to a method for heating hydrocarbon resources in a subterranean formation having a wellbore therein. The method includes coupling a coaxial transmission line, a balun, and a radio frequency (RF) antenna together in series and to be positioned in the wellbore so that the RF antenna heats the hydrocarbon resources in the subterranean formation. The coaxial transmission line includes an inner conductor and an outer conductor surrounding the inner conductor. The balun includes an outer conductive sleeve having a proximal end coupled to the outer conductor of the coaxial transmission line and a medial portion coupled to the inner conductor of the coaxial transmission line. The balun also includes an inner tubular conductor extending longitudinally within the outer conductive sleeve between the outer conductor of the coaxial transmission line and the RF antenna, and a ferrite body surrounding the inner tubular conductor at the proximal end.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate like elements in different embodiments.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate like elements in different embodiments.

Figure 1:
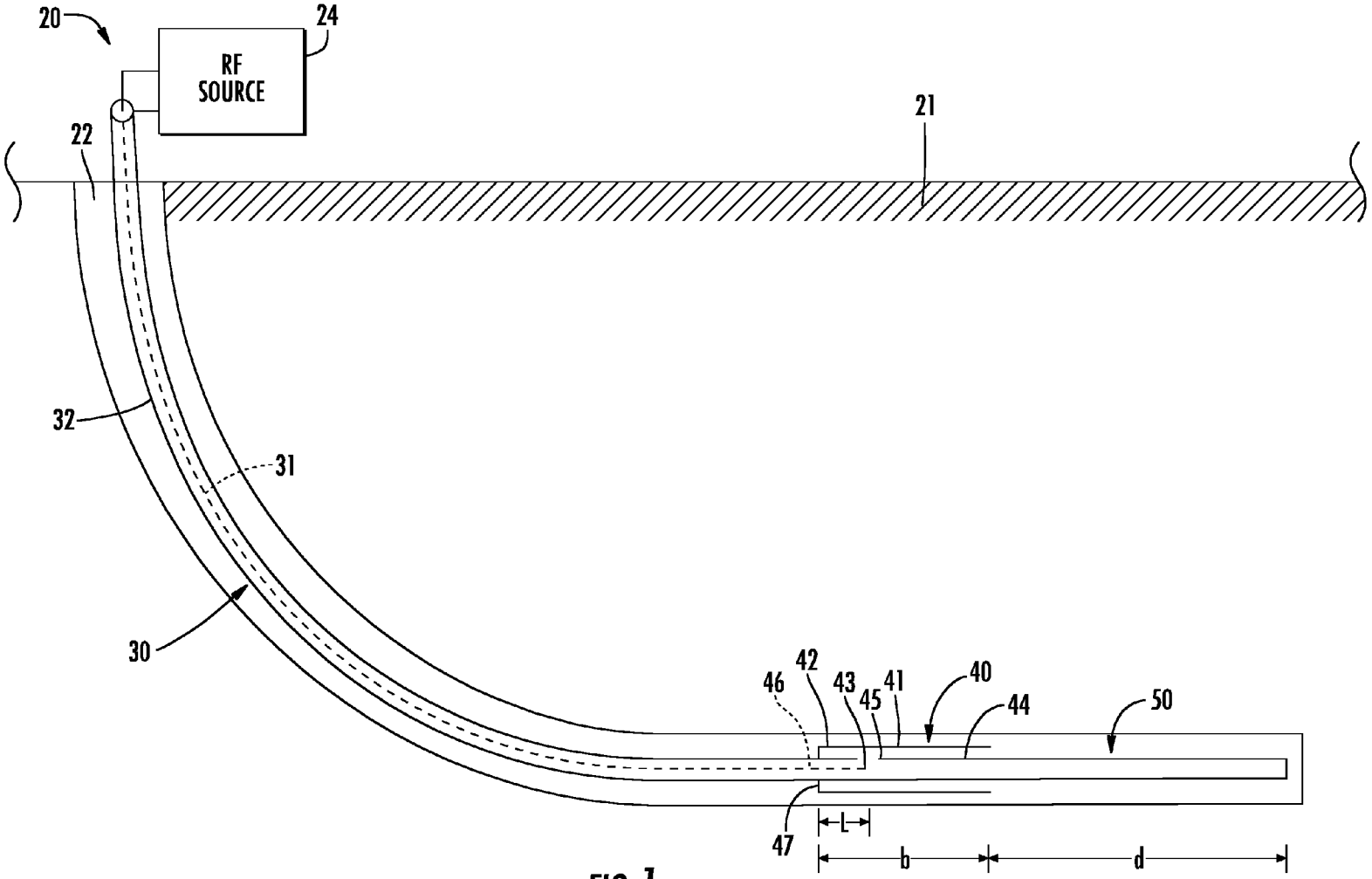
FIG. 1 is a schematic diagram of a system for heating hydrocarbon resources in accordance with the present invention.
Figure 2:
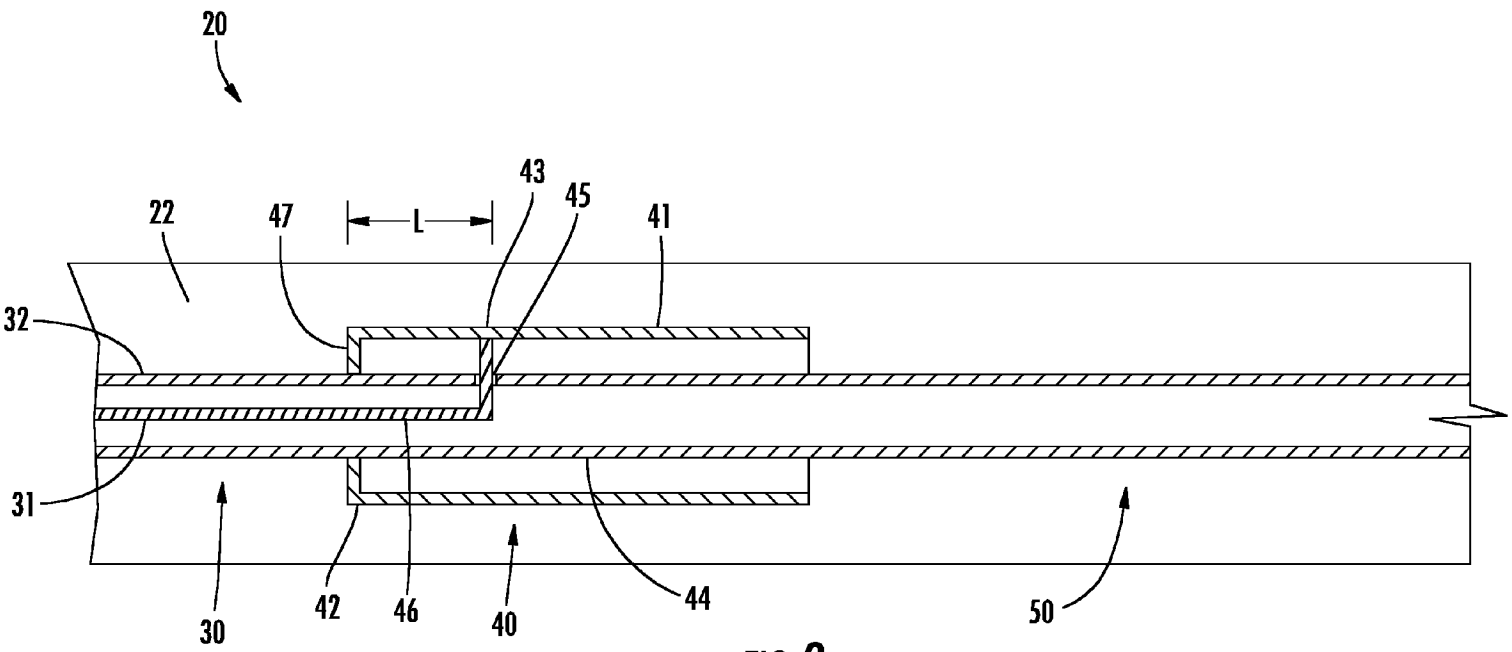
FIG. 2 is an enlarged cross-sectional view of a portion of the system of FIG. 1.

Referring initially to FIGS. 1 and 2, a system 20 for heating hydrocarbon resources in a subterranean formation 21 is described. The subterranean formation 21 includes a wellbore 22 therein. The wellbore 22 illustratively extends laterally within the subterranean formation 21. In some embodiments, the wellbore 22 may be a vertically extending wellbore, for example, and may extend vertically in the subterranean formation 21. Although not shown, in some embodiments a second or producing wellbore may be used below the wellbore 22, such as would be found in a SAGD implementation, for the collection of oil, etc., released from the subterranean formation 21 through heating.

The system 20 includes a coaxial transmission line 30, a balun 40, and a radio frequency (RF) antenna 50 coupled together in series. The coaxial transmission line 30, the balun 40, and the radio frequency (RF) antenna 50 may be made of metal tubing, such as, for example, copper, phosphor bronze, brass, or steel tubing. The coaxial transmission line 30, the balun 40, and the radio frequency (RF) antenna 50 are positioned in the wellbore 22 so that the RF antenna heats the hydrocarbon resources in the subterranean formation 21. The RF antenna 50 may be configured for hydrocarbon extraction, in which case slots may be present. Hydrocarbon processing equipment, such as, for example, pumps may be included in the wellbore 22.

The system 20 also includes an RF power source 24 coupled to the coaxial transmission line 30. The RF power source 24 is illustratively coupled above the subterranean formation 21. In some embodiments, the RF power source 24 may be coupled below the subterranean formation 21. The coaxial transmission line 30 includes an inner conductor 31 and an outer conductor 32 surrounding the inner conductor.

The balun 40 includes an outer conductive sleeve 41 having a proximal end 42 coupled to the outer conductor 32 of the coaxial transmission line 30. More particularly, the balun 40 includes a conductive ring 47 that couples the proximal end 42 of the outer conductive sleeve 41 to the outer conductor 32 of the coaxial transmission line 30. In other words, the uphole end of the balun 40 is short circuited to the coaxial transmission line 30, and the downhole end is open circuited. The balun 40 also has a medial portion 43 coupled to the inner conductor 31 of the coaxial transmission line 30 defining a distance L between the medial portion and the proximal end 42. The electrical resistance of the RF antenna 50 may be adjusted from 0 to 500 Ohms, for example, by adjusting the distance L.

In particular, the resistance may be determined according to the equation:

$$r \approx r_d \tan^{-1}(\beta L)$$

where:

r=the transmitter or RF antenna load resistance in Ohms;

β=the phase propagation constant=2Π/λ=(2Πf)/c;

f=the frequency in Hertz;

c=the speed of light in meters per second;

L=the distance between the proximal end and the medial portion (tap point) in meters;

$r_d$=the driving resistance of the end of the antenna in Ohms;

$r_d$≈3000 Ohms end fed half wave dipole in free space; and $r_d$≈500 Ohms end fed half wave dipole in rich Athabasca oil sand ore.

The physical length b of the outer conductor sleeve 41 may be a ¼ wavelength long, electrically, and given by the formulas:

$$b=(\lambda m/4)/\sqrt{\in_r}$$

$$b=c/[4f\sqrt{(\in_r\mu_r)}]$$

where:

b=the length of the outer conductive sleeve 41 in meters;

$\lambda_m$=the wavelength in the media filling the outer conductive sleeve (if any);

c=the speed in light in meters per second;

$\in_r$=the relative dielectric permittivity (dimensionless) of the media inside the outer conductive sleeve, if any; and $\mu_r$=the relative magnetic permeability (dimensionless) of the media filling inside the outer conductive sleeve, if any.

Other lengths b of the outer conductive sleeve 41 may be used, for example, harmonic lengths or non-resonant lengths to apply reactive loading to the dipole.

The physical length d of the RF antenna 50 down hole from the outer conductive sleeve 41 may be a ½ wavelength long electrically. For example, an RF antenna insulated from the subterranean formation 21, the length d may be given by the approximate formula:

$$d=c/[2f\sqrt{(\in_r\mu_r)}]$$

where:

d=the length of the RF antenna 50, in meters;

$\lambda_m$=the wavelength in the subterranean formation 21;

c=the speed in light in meters per second;

$\in_r$=the relative dielectric permittivity (dimensionless) of the subterranean formation; and $\mu_r$=the relative magnetic permeability (dimensionless) of the subterranean formation.

Other lengths d may be used. For example, for some subterranean formations 21 the length of dimension d has been observed to be partially effected by dielectric permittivity of the subterranean formation, which may be due to inhomogeneous subterranean water distribution. In other words, dimension d may be near the free space half-wavelength when water is not immediately proximate the RF antenna 50. Advantageously, the embodiments may also allow for non-resonant lengths of dimension d by reactive loading from the outer conductive sleeve 41. In other words, if the RF antenna 50 is not resonant, the outer conductive sleeve 41 may be made non-resonant to compensate.

The balun 40 also has an inner tubular conductor 44 extending longitudinally within and spaced from the outer conductive sleeve 41 between the outer conductor 32 of the coaxial transmission line 30 and the RF antenna 50. In some embodiments, a dielectric material or body may be between the inner tubular conductor 44 and the outer conductive sleeve 41.

The inner tubular conductor 44 has an opening 45 therein. A jumper conductor 46 extends through the opening 45 to couple the medial portion 43 of the outer conductive sleeve 41 to the inner conductor 31 of the coaxial transmission line 30.

The balun 40 may define a quarter-wave balun for example, and advantageously doubles as a coaxial matching transformer. More particularly, an outside of the outer conductive sleeve 41 provides the balun, while the inside of the inner tubular conductor 44 provides the quarter-wave matching transformer.

The RF antenna 50 may be in the form of an RF dipole antenna. More particularly, the RF antenna 50 may define a half-wave dipole. Indeed, based upon simulated volume loss density measurements for a coaxial transmission line 30, a balun 40, and a radio frequency (RF) antenna 50 having a combined length of 1250 meters, the RF antenna heats the subterranean formation 21 similarly to a regular center fed dipole antenna.

A scale model prototype system was built in accordance with the system 20 described above. The scale model prototype had a balun made of ⅜ inch outer diameter brass tubing having a length of 2.49 inches, to define a quarter-wave type balun. The RF antenna was 5.5 inches long to define an end fed half-wave RF dipole antenna. The RF dipole antenna was made of 0.141-inch outer diameter copper tube. The distance L between the proximal end and the medial portion was 0.554 inches. The inside of the balun tube was filled with air only.

Figure 3:
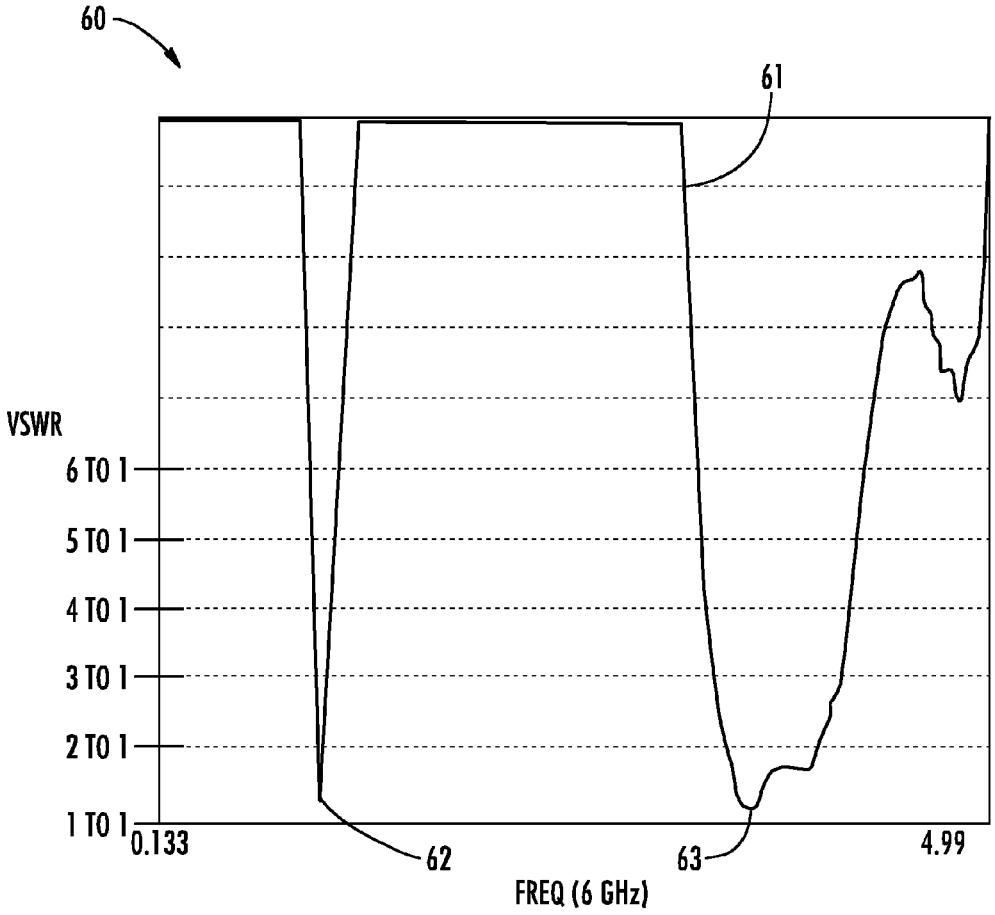
FIG. 3 is a graph of measured voltage standing wave ratio (VSWR) for a prototype system based upon the system of FIG. 1.

Referring now to the graph 60 in FIG. 3, the voltage standing wave ratio (VSWR) of the scale model prototype system was measured in free space and is illustrated by the line 61. Indeed, the prototype system exhibited a low VSWR matching response. For example, the fundamental resonance response was quadratic in shape and occurred at 1019 MHz and 50 ohms as illustrated by the point 62. At the $1^{st}$, fundamental resonance the electrical length of the dipole was 0.47 wavelengths and the electrical length of the balun was 0.21 wavelengths. The third harmonic resonance exhibited a "double tuned" $4^{th}$ order Chebyschev response as illustrated about the point 63 at 3636 MHz.

As background, unless a balun is employed, a coaxial transmission line may carry RF currents on its outer surface due to the radio frequency skin effect and other mechanisms. In the scale model prototype the coaxial transmission line was nearly insensitive to touch, e.g. the measured VSWR did not shift or vary when the transmission line was handled, indicating little to no common mode current had escaped past balun to flow along the outer surface of the coaxial cable between the RF power source and the balun. The RF dipole portion of the system 20 was, however, sensitive to the touch, as it should be. The fact that the resonance frequency and VSWR varied when a human hand was placed nearby the dipole portion, indicated that radiation was occurring, and that the RF dipole near fields coupled inductively to the conductive load media, e.g. the saltwater in the nearby human hand. This inductive coupling may be advantageous for RF heating, and was apparent even at scale.

Figure 4:
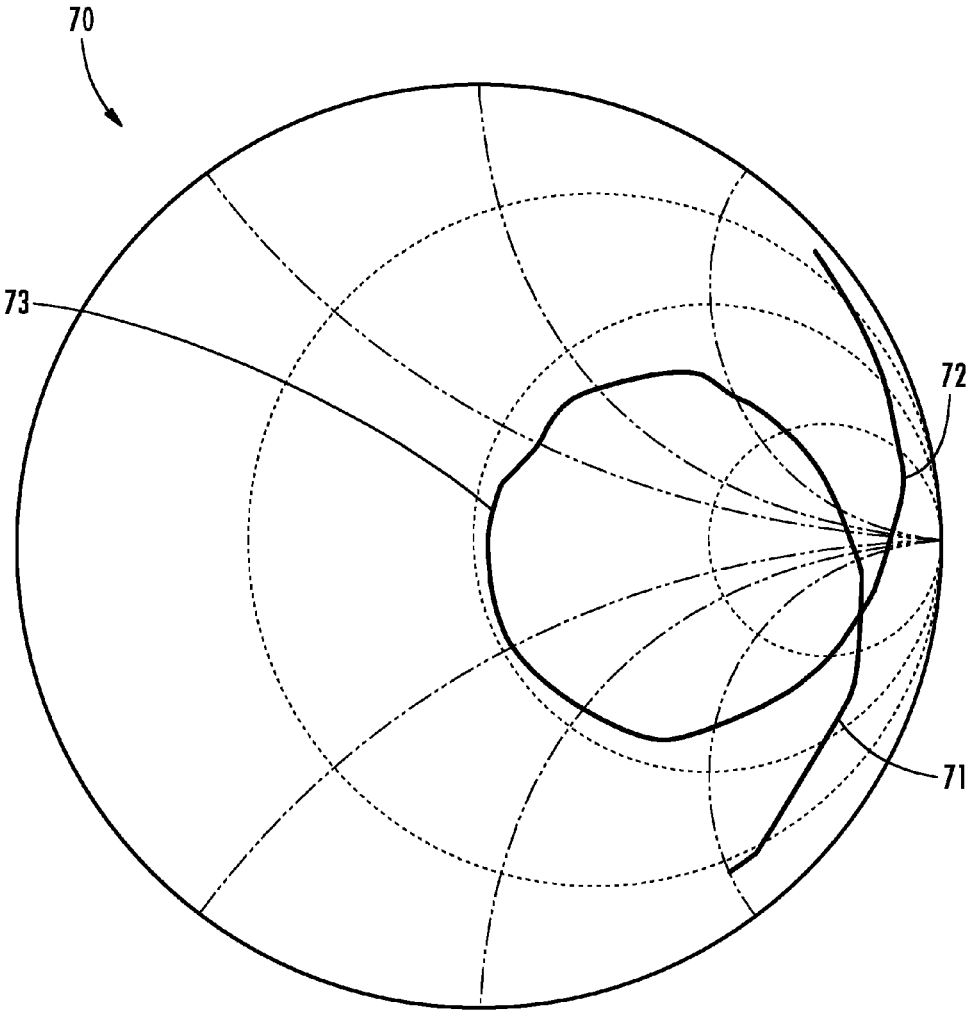
FIG. 4 is a graph of measured impedance for the prototype system based upon the system of FIG. 1.

Referring now to the Smith Chart 70 in FIG. 4, the measured impedance response of the prototype apparatus is illustrated by the limacon shaped trace 71. The antiresonance occurred at 814.5 MHz with a dipole length of $0.38\lambda_{air}$ is illustrated by the point 72. The first resonance is at $0.47\lambda_{air}$ and corresponding to 52 Ohms is illustrated by point 73. The first resonance at $0.47\lambda_{air}$ may be preferred for RF heating for minimum VSWR using 50Ω transmission lines.

Figure 5:
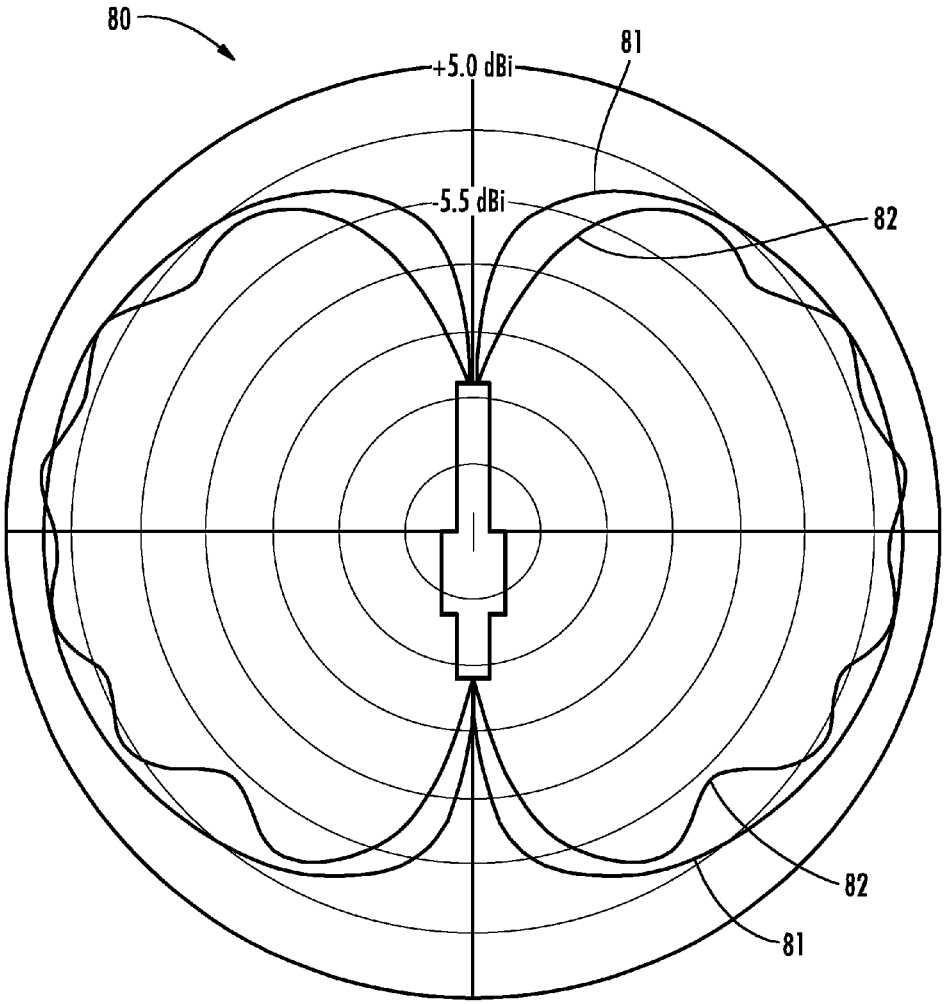
FIG. 5 is a graph of simulated radiation patterns for an ideal dipole and the system of FIG. 1.

Referring now to the graph 80 in FIG. 5, simulated far field free space radiation patterns for both a canonical half wave dipole and the system 20 are illustrated by the curves 81, 82, respectively. Curve 81 is for a center fed half wave dipole, and curve 82 is for an end fed half wave dipole realized by the system 20. Illustratively, the axial cut radiation pattern simulated from the system 20 is similar to the canonical center fed half-wave dipole and is a $\cos^2\theta$ two petal rose geometric shape. The azimuth plane cut radiation pattern, which is cross sectional to the system axis, is circular and has +1 dB of gain.

In an isometric or 3-dimensional view (not shown), the radiation pattern is a donut shaped toroid with the RF antenna 50 passing through the center of the donut hole. Thus, the radiation pattern may be considered omni-directional when the RF antenna 50, for example, is vertical. Polarization may be vertical linear when the system 20, and more particularly, the RF antenna 50, is vertical. The ripple in the pattern may be from minor leakage around the balun 40, as may typically occur. For example, 2 dB of ripple is typically not a problem for communications and/or heating.

An example heating application of the system 20 will now be described. A typical rich Athabasca oil sand reservoir may have a bitumen content of 15%, a water content of 1%, and at 1 MHz, an electrical conductivity of 0.005 mhos/meter, and a relative permittivity of 11. This makes oil sand a radio frequency heating susceptor. If the system 20 is operated in this material at 1 MHz, for example, a preferred length for the RF antenna 50 may be about 400 feet, as this about the half wave resonance when the system 20 is electrically insulated from conductive contact from the subterranean formation 21. The RF antenna 50 typically carries a standing wave of electric current and charges up twice during the AC cycle. This transduces three forms of electromagnetic energy into the subterranean formation 21: electric fields, magnetic fields, and electric currents. The oil sand subterranean formation RF heats by this combination due to: 1) induction of electric currents by electric near fields (capacitive coupling of displacement currents) 2) induction by electric currents by magnetic near fields (magnetic coupling of eddy currents) and 3) forcing of electric conduction currents from bare system 20 surfaces, if any bare surfaces are in conductive contact with the subterranean formation 21. All three of these energies dissipate as heat in the subterranean formation 21 by joule effect, e.g. $I^2R$ resistance heating.

Advantageously, electrode-like contact with the reservoir is typically not required, although it may be present if desired. The system 20 can also beneficially cause dielectric heating in the subterranean formation 21, but typically this dielectric heating is small relative to joule effect heating below about 100 MHz. Later, as the oil sand reservoir connate liquid water is diminished, by extraction or conversion to steam, a relatively large steam saturation zone may form around the RF antenna 50. Radiation of far field radio waves by the system 20 will then occur. Electric and magnetic fields heat via the joule effect where liquid water is encountered. Radio waves can extend the RF heating to any desired distance. In a very simplified sense, the ends of the RF antenna 50 may be conceptually thought of as capacitor plates, the center is a current transformer primary "winding", and eddy currents in the ore are the secondary "winding". Heating patterns observed in simulations of insulated systems in oil sands have been cylindrical to football shaped. The RF antenna 50 may be scaled to practically any desired length by scaling the radio frequency of the power source 24. Half wave resonance lengths may be preferred, although a coaxial matching transformer provided by the balun may efficiently match almost any length of the RF antenna 50. RF heating has greatly increased speed over conducted and steam convection heating in oil sand.

The system 20 may be electrically insulated from the subterranean formation 21 by a dielectric conduit (not shown), by an insulating liquid filling the hole such as mineral oil (not shown), or by a steam saturation zone (not shown). When electrically insulated, system 20 may provide an increasingly reliable subterranean formation 21 by the electric and magnetic fields and their associated radio waves.

It is however also possible to operate the system 20 when it is in conductive electrical contact with the subterranean formation 21. It may be desirable to do this by using a wet startup, for example. The wet startup may be used to grow a steam saturation zone or "steam bubble" around the system 20 to provide the electrical insulation. This may be most easily accomplished by RF heating with the system 20 under impedance mismatch conditions at reduced levels of RF power.

Thus, any VSWR may be tolerated. When low power RF heating is initiated, the RF heating is initially concentrated in a hotspot near the downhole end of the balun 40. However, as the low power wet startup RF heating is continued, a steam bubble forms in the hotspot at the downhole end of the balun 40. As the low power heating is further continued, the steam bubble becomes elongate, remains attached to the system 20, and grows along the entire length of the RF antenna 50 to reach the downhole distal end of RF antenna. Conductive contact with connate subterranean formation liquid water contact is reduced or eliminated as a steam bubble of insulation has enveloped the RF antenna 50. Once the RF antenna is enveloped in the steam bubble, the resistance of the RF antenna 50 rises relatively abruptly, low VSWR may be realized, and high transmit power may then be used. In other words, the wet start up method may be used to transmit at low power into a "shorted out" system 20 until water contact is boiled off. Most high power RF power sources/transmitters generally supply the low levels of RF power desired regardless of resistance and VSWR. Of course, the system 20 may be insulated from the subterranean formation by other means if desired.

Figure 6:
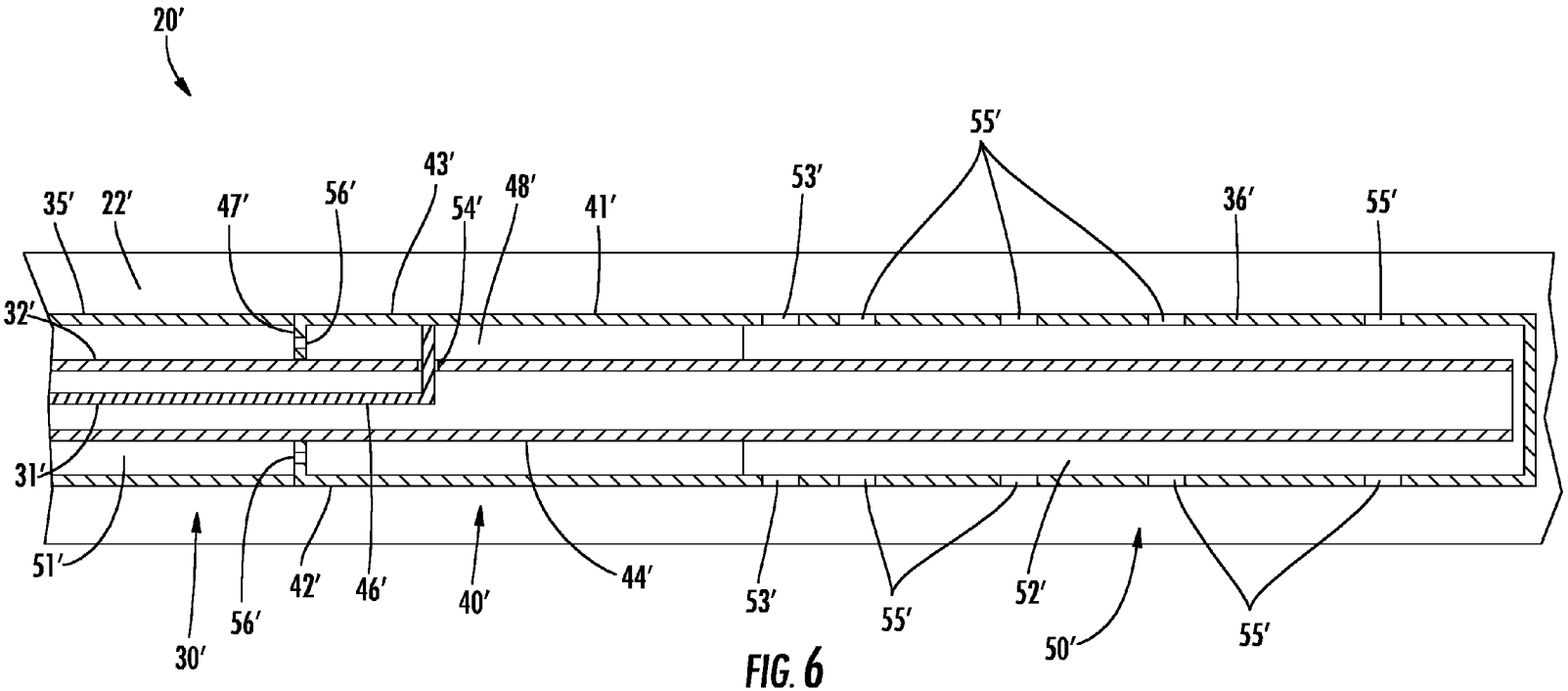
FIG. 6 is an enlarged cross-sectional view of a portion of a system for heating hydrocarbon resources in accordance with another embodiment of the present invention.

Referring now to FIG. 6, in another embodiment, the outer conductive sleeve 41' and the inner tubular conductor 44' of the balun 40' define a first fluid passageway 48' therebetween. A first casing 35' surrounds the coaxial transmission line 30' to define a second fluid passageway 51' therebetween aligned with the first fluid passageway 48'. A second casing 36' surrounds the RF antenna 50' to define another or third fluid passageway 52' therebetween, and also aligned with the first and second fluid passageways 48', 51'. A first dielectric spacer 53' may be coupled between the outer conductive sleeve 41' of the balun 40' and the second casing 36'. A second dielectric spacer 54' may be positioned in the opening of the inner tubular conductor 44' to maintain continuity between the first, second and third fluid passageways 48', 51', 52'.

An opening 56' in the conductive ring 47' permits fluid to pass from the second fluid passageway 51' to the first fluid passageway 48'. Of course, more than one opening may be formed in the conductive ring 47'.

A fluid, for example, a solvent, may be passed through the first, second and third fluid passageways 48', 51', 52'. The second casing 36' may have spaced apart openings 55' therein to permit the fluid to be dispersed adjacent the RF antenna 50'. The outer conductive sleeve 41' may also have one or more openings therein to permit fluid to be dispersed therefrom adjacent the balun 40'.

In particular, the embodiment described with respect to FIG. 6 may be used to combine RF Heating (RFH) with the Vapor Extraction Process (VAPEX) methods of enhanced oil recovery (EOR). In this combination, a method may include both RF heating and solvent injection in the subterranean formation by the system 20'. Relatively fine slits or other apertures may be configured into the RF antenna 50' to inject the solvent. A synergy may occur from the combined RF heating-solvent injection method: the solvent dissolves and thins the heavy hydrocarbons, and the RF heating drives the solvent into the subterranean formation 21'. The combination reduces the operating temperatures otherwise desired for enhanced oil recovery by RF heating alone, and the increased temperatures greatly increase production rates over VAPEX alone. The injected solvents may include alkanes, such as, for example, butane or propane. Selecting the solvent(s) may include selecting the solvent(s) based on solvent molecular weight and solvent boiling point as the boiling point temperature at reservoir pore pressure regulates the subterranean operating temperature. Bitumen is melted at an expanding front of solvent vapor surrounding the dipole antenna. Production may be cyclic with repeated injection, RF heating, and production cycles.

There is partial upgrading of bitumen to oil in the subterranean formation 21'. New solvent in the form of toluene may also be created from the connate water and bitumen, the electromagnetic fields providing the catalyst and the connate water providing hydroxyl radicals. Toluene formed methyl group attaching to the polycyclic aromatic rings may be common in bitumen. Magnetic fields from the RF dipole antenna 50 may also thin oil by asphalt particle agglomeration, modifying oil rheological properties.

Figure 7:
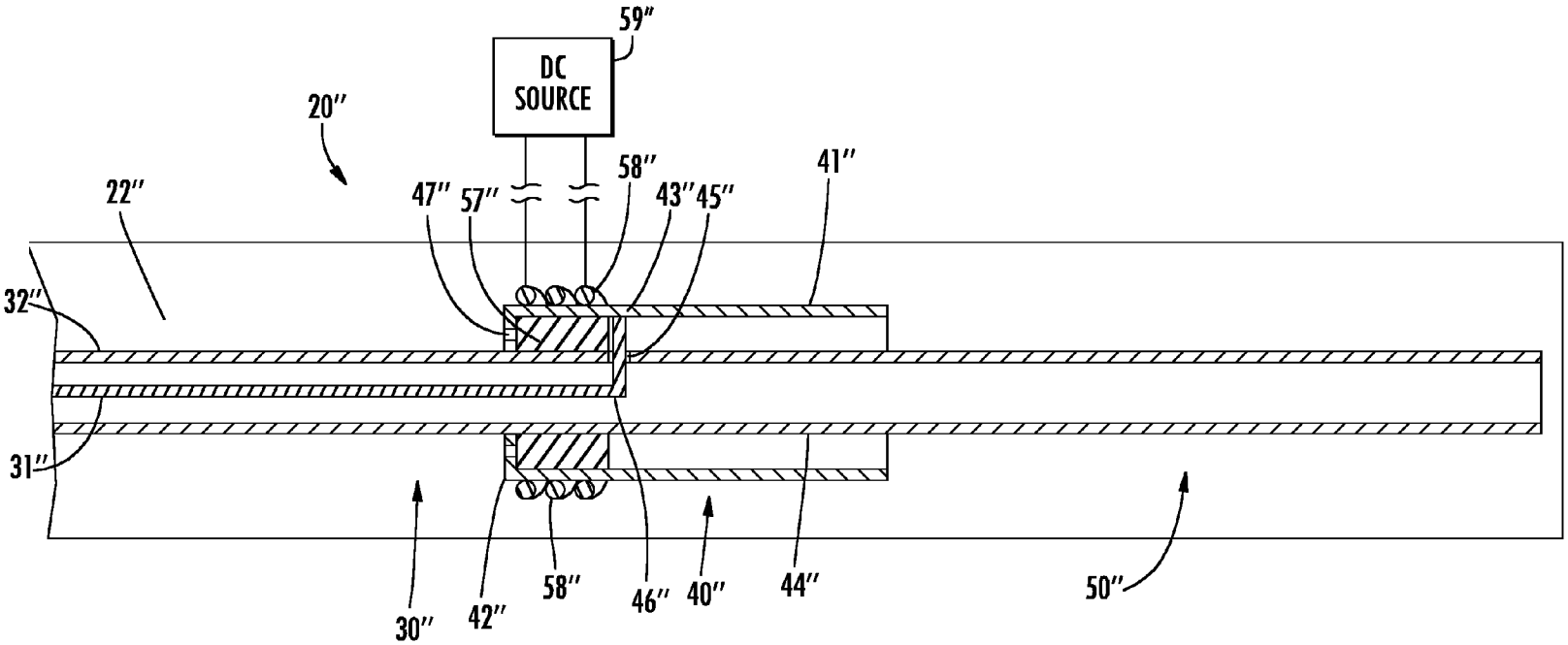
FIG. 7 is an enlarged cross-sectional view of a portion of a system for heating hydrocarbon resources in accordance with yet another embodiment of the present invention.

Referring now to FIG. 7, in yet another embodiment, electronic tuning and impedance matching may be provided by including a changeable media in the balun 40". In a preferred implementation, the changeable media may be in the form of ferrite body 57" which surrounds inner tubular conductor 44" at the proximal end 42". More particularly, the ferrite body 57" is coupled between the inner tubular conductor 44" and the outer conductive sleeve 41". The system also includes a biasing electromagnet 58" surrounding the outer conductive sleeve 41" also adjacent the proximal end 42". In particular, the biasing electromagnet 58" may be in the form of windings surrounding the outer conductive sleeve 41" and the ferrite body 57". Of course, another type of electromagnet may be used. A direct current (DC) source 59" is illustratively coupled to the windings 58". The windings 58" and the ferrite body 57" provide further adjustment of the resistance of the RF antenna 50".

This occurs as the DC/steady state magnetic fields from the biasing electromagnet 58" constrain the magnetic domains of the ferrite body 57", which changes the relative permeability of the ferrite body at radio frequencies. This, in turn, varies the electrical length of the tapped coaxial impedance transformer the balun 40" provides, which, in turn, varies the electrical load resistance that is referred to the coaxial transmission line from the RF antenna 50". Examples of biasing magnetic media for load management are described in both U.S. patent application Ser. No. 13/657,172 and U.S. Pat. No. 7,889,026, assigned to the present assignee, and the entire contents of which are herein incorporated by reference. Alternative ferromagnetic changeable media 57" may include nanocrystalline iron windings and laminations, or powdered iron having coated grains. In some embodiments, a fluid media may include the changeable media. Adjusting a fluid type changeable media may include exchanging fluid types to obtain different dielectric permittivity and or magnetic permeability fills in the balun 40".

In some embodiments, the ferrite body 57" may be a remnant magnetic ferrite body such that the electromagnet 58" supplies pulsed magnetic fields to build up a permanent magnetic field. This may advantageously reduce the need to provide continuous DC power to the electromagnet 58", as a number DC pulses applied may adjust the relatively permeability of the remnant magnetic ferrite body 57". Adjusting the permeability in turn adjusts or "tunes" the electrical length of the balun 40 Thus, adjusting the number of DC electromagnet pulses adjusts the resistance of the antenna 50, which may reduce the transmission line VSWR. Additionally, if the ferrite body 57" is located adjacent the transformer tap jumper of the balun 40, then adjustments to the relatively permeability adjusts resistance of the antenna 50.

Numerous advantages may be provided by the system 20. Indeed, the system 20 may be particularly advantageous for operation in relatively smaller diameter wellbores, which may reduce operating costs and increase efficiency. The system 20 may also allow operation with a larger range of hydrocarbon resource conductivities via the adjustable antenna resistance, for example, a conventional center fed half wave dipole may not generate sufficient electrical resistance in highly conductive reservoirs. The number of parts that comprise the system 20 may also be reduced with respect to alternative systems. Double tuning may also be adjusted, and the desire for series antenna insulators and/or isolators may be reduced, since center fed dipoles fed from the side or coaxial inset typically require center insulators.

The system 20 advantageously may only require centralizing type insulators, such as spacing rings, to hold coaxial tubes concentric, and these ring-type insulators may be subject to compression forces only (no tension), such that even compression only ceramic type insulating materials may be used. The heated region of the system 20 is the dipole segment downhole from the balun 40, and it may not include electrical wiring, insulators, or isolators, etc. The heated region of the system 20 may be a metal tube, a rod, or a wire, for example. The relatively simplicity of a tubing-based dipole heating segment, e.g. the tubular metallic radio frequency (RF) antenna 50, advantageously allows many modifications, for example, equipment, inside that tube, such as, for example, the addition of downhole pumps, conveying steam for combined RF heating and steam injection, conveying solvent or fluids for subterranean injection, cutting drainage slits, installation of preheating toe and heel tubing for conducted heating with steam, installing downhole instrumentation, performing coaxial drilling or worming, etc. None of these enhancements interact or preclude the RF heating by the RF antenna 50. The interior of a tubular metallic radio frequency (RF) antenna 50 may be electrically shielded as the conductive tube provides a Faraday Cage.

A method aspect is directed to a method for heating hydrocarbon resources in a subterranean formation 21 having a wellbore 22 therein. The method includes coupling a coaxial transmission line 30, a balun 40, and a radio frequency (RF) antenna 50 together in series and positioning them in the wellbore 22 so that the RF antenna heats the hydrocarbon resources in the subterranean formation 21. The coaxial transmission line 40 includes an inner conductor 31 and an outer conductor 32 surrounding the inner conductor. The balun 40 includes an outer conductive sleeve 41 having a proximal end 42 coupled to the outer conductor 32 of the coaxial transmission line 30 and a medial portion 43 coupled to the inner conductor 31 of the coaxial transmission line 30. The balun 40 also includes an inner tubular conductor 44 extending longitudinally within the outer conductive sleeve 41 between the outer conductor 32 of the coaxial transmission line 30 and the RF antenna 50.

The balun 40 also includes a ferrite body 57" coupled between the inner tubular conductor 44 and the outer conductive sleeve 41 to surround the inner tubular conductor at the proximal end 42. An electromagnet 58" in the form of windings surrounds the outer conductive sleeve 41 adjacent the proximal end 42.

Another method aspect is directed to separately adjusting the resistance from the reactance of the RF antenna 50. The resistance of the RF antenna 50 is adjusted by adjusting the location of the tap point L, and the reactance is independently adjusted by changing the frequency of the RF power source 24. The operating frequency may be adjusted to track the resonance of the RF antenna 50 so that reactance is maintained at zero or nearly zero. The controls over resistance and reactance may be independent or nearly so. Thus the system 20 advantageously handles a wide range of hydrocarbon ore electrical characteristics and the changes in ore electrical characteristics that may occur during heating.

As can be appreciated, a subterranean RF heating system may operate at high RE power levels, such as, for example, 5 kilowatts per meter of payzone, or 5 megawatts for a 1 kilometer long horizontal directional drilling heated zone such that antenna presents a relatively low VSWR load to the transmission line. As hydrocarbon overburden is typically more conductive than a hydrocarbon payzone, it may be relatively desirable that a shielded transmission line be used since overburden heating may not be economic. Coaxial transmission lines generally offer the best trades between lowest loss, highest power handing, and highest voltage handling for resistive loads between about 30 and 70 ohms. The system 20 advantageously provides a resonant nonreactive antenna load impedance adjustable throughout this range.

Indeed, while the system 20 has been conceptually described with respect to an RF transmission line 30, a balun 40, and an RF antenna 50, it will be appreciated that the system may be formed monolithically or may be multiple different physical structures coupled together. Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for heating hydrocarbon resources in a subterranean formation having a wellbore therein comprising:
- a coaxial transmission line, a balun, and a radio frequency (RF) antenna coupled together in series and configured to be positioned in the wellbore;
- said coaxial transmission line comprising an inner conductor and an outer conductor surrounding said inner conductor;
- said balun comprising
  - an outer conductive sleeve having a proximal end coupled to said outer conductor of said coaxial transmission line and a medial portion coupled to said inner conductor of said coaxial transmission line,
  - an inner tubular conductor extending longitudinally within said outer conductive sleeve between said outer conductor of said coaxial transmission line and said RF antenna, and
  - a ferrite body surrounding said inner tubular conductor at the proximal end.

2. The system of claim 1, further comprising an electromagnet surrounding said outer conductive sleeve adjacent the proximal end.

3. The system of claim 2, wherein said electromagnet comprises a plurality of windings.

4. The system of claim 1, wherein said ferrite body is coupled between said inner tubular conductor and said outer conductive sleeve.

5. The system of claim 1, wherein said inner tubular conductor has an opening therein, and wherein said balun further comprises a jumper conductor extending through the opening to couple the medial portion of said outer conductive sleeve to said inner conductor of said coaxial transmission line.

6. The system of claim 1, wherein said balun further comprises a conductive ring coupling the proximal end of said outer conductive sleeve to said outer conductor of said coaxial transmission line.

7. The system of claim 1, wherein said outer conductive sleeve is spaced from said inner tubular conductor.

8. The system of claim 1, further comprising:
- a first casing surrounding said coaxial transmission line to define a fluid passageway therebetween; and
- a second casing surrounding said RF antenna to define another fluid passageway therebetween.

9. The system of claim 1, further comprising an RF source coupled to said coaxial transmission line.

10. The system of claim 1, wherein said RE antenna comprises an RF dipole antenna.

11. A system for heating hydrocarbon resources in a subterranean formation having a wellbore therein comprising:
- a coaxial transmission line, a balun, and a radio frequency (RE) antenna coupled together in series and configured to be positioned in the wellbore; and
- an RF source coupled to said coaxial transmission line;
- said coaxial transmission line comprising an inner conductor and an outer conductor surrounding said inner conductor;
- said balun comprising
  - an outer conductive sleeve having a proximal end coupled to said outer conductor of said coaxial transmission line and a medial portion coupled to said inner conductor of said coaxial transmission line,
  - an inner tubular conductor extending longitudinally within said outer conductive sleeve between said outer conductor of said coaxial transmission line and said RF antenna,
  - a ferrite body surrounding said inner tubular conductor at the proximal end, and
  - an electromagnet surrounding said outer conductive sleeve adjacent the proximal end.

12. The system of claim 11, wherein said electromagnet comprises a plurality of windings.

13. The system of claim 11, wherein said ferrite body is coupled between said inner tubular conductor and said outer conductive sleeve.

14. The system of claim 11, wherein said inner tubular conductor has an opening therein, and wherein said balun further comprises a jumper conductor extending through the opening to couple the medial portion of said outer conductive sleeve to said inner conductor of said coaxial transmission line.

15. The system of claim 11, wherein said balun further comprises a conductive ring coupling the proximal end of said outer conductive sleeve to said outer conductor of said coaxial transmission line.

16. A method for heating hydrocarbon resources in a subterranean formation having a wellbore therein, the method comprising:
- coupling a coaxial transmission line, a balun, and a radio frequency (RF) antenna together in series and positioned in the wellbore so that the RF antenna heats the hydrocarbon resources in the subterranean formation, the coaxial transmission line comprising an inner conductor and an outer conductor surrounding the inner conductor;
- the balun comprising
  - an outer conductive sleeve having a proximal end coupled to the outer conductor of the coaxial transmission line and a medial portion coupled to the inner conductor of the coaxial transmission line, an inner tubular conductor extending longitudinally within the outer conductive sleeve between the outer conductor of the coaxial transmission line and the RF antenna, and a ferrite body surrounding the inner tubular conductor at the proximal end.

17. The method of claim 16, wherein the balun further comprises an electromagnet surrounding the outer conductive sleeve adjacent the proximal end.

18. The method of claim 17, wherein the electromagnet comprises a plurality of windings.

19. The method of claim 16, wherein the ferrite body is between the inner tubular conductor and the outer conductive sleeve.

20. The method of claim 16, wherein the inner tubular conductor has an opening therein, and wherein the balun further comprises a jumper conductor extending through the opening to couple the medial portion of the outer conductive sleeve to the inner conductor of the coaxial transmission line.

* * * * *